US005709326A

United States Patent [19]

Fröhlich

[11] Patent Number: 5,709,326

[45] Date of Patent: Jan. 20, 1998

[54] METHOD AND APPARATUS FOR INSPECTING AND SHAPING PANTYHOSE

[75] Inventor: Eckhard Fröhlich, Steinheim, Germany

[73] Assignee: Wepamat Maschinenbau GmbH, Weilheim/Teck, Germany

[21] Appl. No.: 581,854

[22] Filed: Jan. 2, 1996

[30] Foreign Application Priority Data

Jan. 4, 1995 [DE] Germany ..... 195 00 100.1

[51] Int. Cl.[6] ..... D06C 5/00

[52] U.S. Cl. ..... 223/76; 223/77

[58] Field of Search ..... 223/76, 77, 75, 223/51

[56] References Cited

U.S. PATENT DOCUMENTS

| | | | |
|---|---|---|---|
| 3,486,471 | 12/1969 | De Spain | 223/75 |
| 4,434,918 | 3/1984 | Hodges | 223/76 |
| 4,703,877 | 11/1987 | Kuniki et al. | 223/76 |
| 5,094,371 | 3/1992 | Takamura et al. | 223/75 |
| 5,438,775 | 8/1995 | Chietti et al. . | |

FOREIGN PATENT DOCUMENTS 2104564 6/1981 United Kingdom .

*Primary Examiner*—Bibhu Mohanty
*Attorney, Agent, or Firm*—Harness, Dickey & Pierce, P.L.C.

[57] ABSTRACT

There are provided a device and a method for shaping and inspecting pantyhose for defects comprising flat stretchers for stretching the pantyhose, the stretchers being arranged in pairs one beside the other and so that they can be brought into a mutually aligned position and the pantyhose being preferably exposed to the action of steam in a steam-shaping station. In order to permit visual inspection of both the front and the back faces of the pantyhose, neighboring stretchers are rotatable by approximately 180° about a common axis so that the fully spread pantyhose can be inspected easily and by direct eye contact. Subsequent heat-treatment is effected on the same stretchers, preferably by means of steam. The device is preferably designed as circular indexing machine, where the stretchers are arranged in pairs along the circumference of a rotary plate by means of which the stretchers are indexed through the different treating stations.

6 Claims, 1 Drawing Sheet

METHOD AND APPARATUS FOR INSPECTING AND SHAPING PANTYHOSE

BACKGROUND OF THE INVENTION

The present invention relates to a device for shaping pantyhose and for inspecting pantyhose for defects, having a rotary plate capable of rotating about its vertical axis and carrying a plurality of flat stretchers arranged in pairs one beside the other along its circumference, and having further a plurality of treating stations that are arranged along the rotary plate and between which the stretchers can be moved in a cycle-controlled way, by rotation of the rotary plate, the stretchers being arranged in such a way that they can be brought into a mutually aligned position for spreading the pantyhose and that two neighboring stretchers can be turned at least by approximately 180° about a common axis in order to permit visual inspection of both the front and the back faces of a spread pantyhose.

The invention further relates to a method for inspecting pantyhose where the pantyhose is mounted on flat stretchers arranged in pairs one beside the other and in mutually aligned position, and where for inspecting the back face of the pantyhose the stretchers are turned about a common axis by at least 180°.

A device and a method of the before-mentioned kind have been known from DE-32 22 330 A1.

In the case of the known device, the pantyhose is initially mounted on small inspection stretchers, where at first their front and, after rotation by 180°, their back faces are inspected for defects. Upon completion of the inspection operation, the pantyhose is pulled off the inspection stretchers and is then transferred to long stretchers arranged on a carrousel, for being transferred to subsequent stations for thermal treatment and, later, removal.

Thermal treatment is effected in this case in the known manner, by means of hot air or similar heating means.

It has been found to be a disadvantage of such known device that for inspecting the pantyhose it has to be mounted at first on a separate stretcher, must then be pulled off again and mounted once more on a longer stretcher. This increases the risk of damage due to the additional pulling-off and mounting process. And moreover, the inspection of the pantyhose on the inspection stretchers is very imprecise, the stretcher being in fact spread on the stretchers at best in the area of the leg sections.

A similar device and a similar method have been known from GB-2 081 321.

After the dyeing process, higher-quality pantyhose undergoes a shaping and drying process, after which it is inspected for defects.

To this end, the two leg sections of the pantyhose are pulled onto two stretchers arranged one beside the other, and are then subjected to a dry heat treatment, for example to infrared radiation, or they are treated with steam in a steam chamber.

As the possible defects are numerous with pantyhose, and may consist for example of holes, stitch defects, drawn meshes, fabric defects, defective seams, color defects or color variations, the pantyhose is visually inspected for defects prior to being heat treated.

Where the pantyhose is to be subjected to dry heat treatment (so-called "semi-shaping"), the pantyhose is normally pulled onto substantially U-shaped frames that consist of a round material bent to a U shape. The dimensions of such stretchers are selected in such a way that the leg sections of a pair of pantyhose are spread so that a visual quality examination of the two sections can be carried out before the background of a viewing screen. The two stretchers are aligned so that both of them lie in a single plane and are, thus, aligned one with the other. The stretchers are spaced apart one from the other to that the panty section of the pantyhose is also spread apart, particularly in the gusset region, so that a visual quality examination can also be performed in this critical gusset region where a plurality of seams is present in most cases. The pantyhose, being thus pulled onto the two stretchers and being spread, is presented to a person who is to perform the visual quality examination by looking at the stretcher planes and, thus, directly inspecting the front faces of the stretched pantyhose.

While this process enables both pantyhose faces to be visually inspected against a viewing screen in a relatively simple way, it can be used only in combination with fork-like stretchers. Transparent full-surface stretchers suited for the high temperatures involved have not become known to this day. Given the fact that both pantyhose faces are inspected at the same time, any defects present on the back face of the pantyhose, especially displaced meshes, can be detected only with difficulty. And in the area immediately behind the tubular material of the stretchers, no examination can be carried out at all.

According to another known method, prior to carrying out the shaping process as such, the pantyhose is pulled onto transparent inspection stretchers where it is examined for defects against a viewing screen (US-A-4 703 877).

However, as such stretchers are not suited for subsequent thermal treatment, the pantyhose must be pulled off the stretchers after the examination process, for being mounted on another stretcher for the subsequent shaping process. This is a relatively complicated and expensive operation which additionally provides the risk that the pantyhose may be damaged by the additional pulling-off and mounting process. And again, defects present on the back face of the pantyhose can be detected only with difficulty.

Further, steam-shaping machines have been known for effecting what is known as "full-shaping" of pantyhose (compare US-A-5 094 371); these machines use full-size flat stretchers which provide especially efficient smoothing of the material.

However, with shaping machines of that kind either the pantyhose is likewise inspected from the front only, or else inspection of the back face is carried out with the aid of large mirrors placed obliquely behind the stretchers.

However, while such mirrors do permit the back faces of pantyhose to be inspected, this procedure is extremely tiresome due to the fact that the operator is required to inspect the front face first, and to then turn his/her eyes to the left and to the right for inspecting the back face. In addition, this operation requires the use of reduction mirrors as otherwise it would be impossible to view the back face in its entirety. As a result of the reduced image provided by the mirrors and the oblique projection of the back face, only bigger defects can be detected in this way.

It has further been proposed to arrange the two stretchers at a larger distance one from the other (approximately 90 mm between the stretchers, instead of the usual 60 mm) and to locate two obliquely oriented mirrors centrally behind such stretchers. This allows an operator to inspect the front of the pantyhose directly, while the back face can be inspected indirectly, via the centrally arranged mirrors.

This arrangement is, however, connected with the disadvantage that on the one hand the increased spacing between the two stretchers may lead to overdue stretching of the pantyhose, especially in the gusset area, whereby the pantyhose may get damaged. In addition, regarding the pantyhose alternately from the front and from the back, viewing through the middle, leads to sort of a cross-eyed effect that causes rapid tiring of the operator.

SUMMARY OF THE INVENTION

Now, it is an object of the present invention to provide a device and a method for shaping and inspecting pantyhose which make the process easy and non-tiring while permitting both the front and the back faces of the pantyhose to be subjected to complete quality examination.

Further, it is another object of the invention to provide a device and a method for shaping pantyhose, which in the case of steam shaping permit non-tiring quality examination without extending the cycle time.

Finally, it is still another object of the invention to avoid the need for mounting pantyhose on inspection stretchers for the inspection operation whereafter the pantyhose has to be pulled off the stretchers and to be transferred to other stretchers for the heat-treatment operation.

The before-mentioned and still other objects are achieved by a device comprising flat stretchers for stretching the pantyhose, the stretchers being arranged in pairs one beside the other and so that they can be brought into a mutually aligned position, and comprising further means for heat-treating the pantyhose while mounted on the stretchers, two neighboring stretchers being rotatable by approximately 180° in order to permit visual inspection of both the front and the back faces of a stretched pantyhose and the subsequent heat-treatment being effected after the inspection operation, with the pantyhose mounted on the same stretchers.

These and still other objects are further achieved by a method for inspecting and shaping pantyhose, where the pantyhose is initially mounted on stretchers arranged in pairs one beside the other and in mutually aligned positions, and is then visually inspected from the front, whereafter the stretchers are rotated about a common axis by at least approximately 180°, the pantyhose is then visually inspected at its back and is finally heat-treated while mounted on the same stretcher.

It is thus possible to reliably inspect the pantyhose for defects, both at its front and at its back, by direct eye contact. The method may be carried out using both frame-type or solid stretchers. As no mirrors are required for inspecting the back face, and since the back face can be inspected by direct eye contact, even very small defects will be reliably detected. Any distortions and reductions that may be produced by mirrors are thus avoided. And in addition the process is substantially non-tiring, as it avoids the need for constantly turning the head and for unnatural eye movements, allowing the pantyhose to be inspected from the front, by direct eye contact.

Since the pantyhose is fully stretched on a relatively long stretcher which is also used for later heat-treatment, the pantyhose can be completely inspected, in particular also in the gusset region, on the front side and on the back side as well. Moreover, inspection stretchers are avoided, since the pantyhose is inspected on the same stretchers on which the heat-treatment is performed later on.

According to an advantageous further development of the invention, there is provided a rotary plate capable of rotating about its vertical axis and carrying a plurality of stretchers arranged in pairs one beside the other along its circumference, there being further provided a plurality of treating stations that are arranged along the rotary plate and between which the stretchers can be moved in a cycle-controlled way, by rotation of the rotary plate.

It has surprisingly been found that sufficient space is available with this arrangement for the respective rotary means and that, on the other hand, the cycle time of the shaping device is not detrimentally influenced as the drying and shaping process anyway requires a certain time.

According to an advantageous further development of this embodiment, there are provided at least one mounting and inspection station, one shaping station with a steam chamber, one drying station ad one pulling-off station.

Especially in the case of a steam-shaping machine, the additional operation of turning the stretchers does not in fact result in a longer cycle time.

That is, it has been found according to the invention that in order to achieve a satisfactory smoothing effect in the steam chamber, hot steam at temperatures of approximately 120° to 140° must be permitted to act on the pantyhose for at least one second. Taken all together, one obtains a maximum cycle time of approximately twelve cycles per minute, corresponding to a cycle time of 5 seconds, the remaining time being required for opening and closing the steam chamber, for locking and unlocking the steam chamber, for building up and releasing the pressure in the steam chamber, and for indexing the rotary plate. If one assumes that indexing the rotary plate takes one second and that during that time an operator picks up a pantyhose, there are 4 seconds left for mounting a new pantyhose on a stretcher, for inspecting the front, rotating the pantyhose and inspecting its back during stoppage of the machine at the mounting and inspection station.

If the time required for pulling the pantyhose onto a stretcher is assumed to be approximately one second, there remains approximately one second for inspecting the front, approximately one second for turning the pantyhose and one second for inspecting the back of the pantyhose, without the total time of four seconds being exceeded. The invention, therefore, permits non-tiring precise examination of the front and back of the pantyhose without extending the cycle time.

Another special advantage is further seen in the fact that the examination can be carried out directly in the fully-stretched condition of the pantyhose and on the same stretchers on which the pantyhose will later be subjected to the subsequent heat-treatment. The invention, therefore, permits to do without the additional—in most cases short—inspection stretchers on which the pantyhose can be spread only in part. The invention thus eliminates an additional pulling-off and mounting operation without extending the cycle time, while enabling at the same time a fully stretched pantyhose to be inspected on both sides in a non-tiring way.

It is understood that the features mentioned above and those yet to be explained below can be used not only in the respective combinations indicated, but also in other combinations or in isolation, without leaving the scope of the present invention.

One preferred embodiment of the invention will be explained hereafter in more detail with reference to the drawing.

BRIEF DESCRIPTION OF THE DRAWING

The single FIGURE shows a simplified, diagrammatic top view of a device according to the invention for shaping pantyhose and for inspecting it for defects.

DETAILED DESCRIPTION OF THE PREFERRED EMBODIMENT

Figure 1:
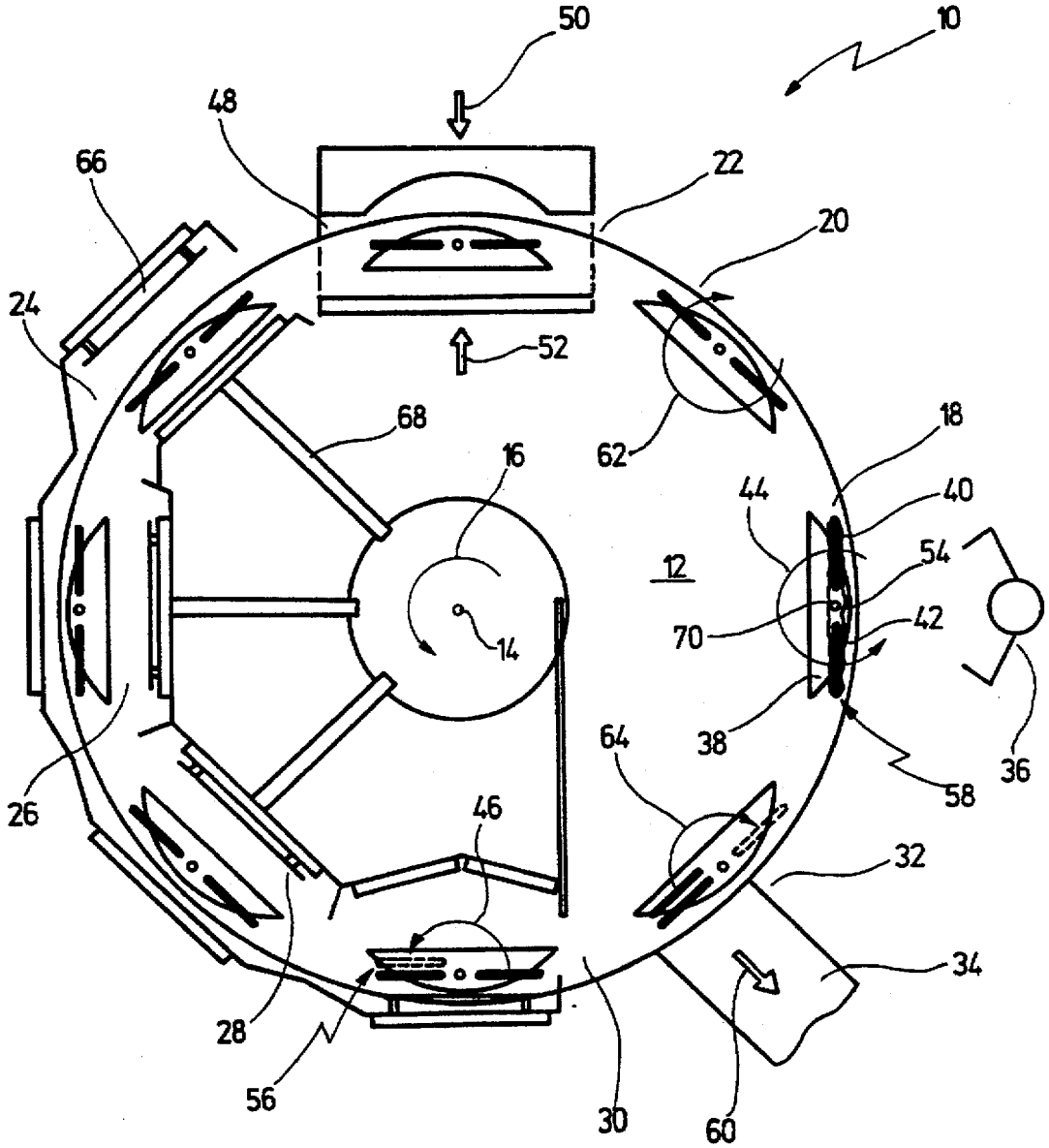

A device according to the invention for shaping and inspecting pantyhose is generally indicated in the FIGURE by reference numeral 10.

The device consists of a so-called circular indexing machine, where a plurality of treating stations 18, 20, 22, 24, 26, 28, 30, 32 are arranged along the circumference of a rotary plate 12 that can be rotated about a vertical axis 14, i.e. in the illustrated example in counter-clockwise direction, as indicated by arrow 16.

A series of stations arranged along the circumference of the rotary plate 12 consists of a mounting and inspection station 18, an intermediate station 20, a shaping station 22 with a steam chamber 48, four drying stations 24, 26, 28, 30, and one pulling-off station 32, where the pantyhose 70 is pulled off and transferred, in the direction indicated by arrow 60, to a downstream packaging line 34.

The process starts by an operator 36 pulling a pantyhose 70 at the mounting and inspection station 18 onto the two stretchers 40, 42 arranged in a common plane one beside the other and in mutually aligned position 58, which process may be assisted by an automatic mounting device.

Once the pantyhose 70 is fully spread on the two stretchers 40, 42, the pantyhose 70 is inspected for defects initially at its front. Thereafter, the pantyhose 70 is turned by 180°, by rotating the two stretchers 40, 42 about a common axis 54 in the direction of arrow 44, whereafter the back of the pantyhose 70 can be inspected.

For this purpose, the two stretchers 40, 42 are preferably fastened on a turning unit 38 of crescent-shaped cross-section, viewed from the top, which on the one hand enables the two stretchers 40, 42 to be jointly turned about the common axis 54, and permits on the other hand the first stretcher 40 to be turned by 180° relative to the second stretcher 42 in order to bring the two stretchers 40, 42 into a mutually parallel position 56, as indicated by arrow 46.

Such rotation of the two stretchers one relative to the other is effected at the last drying station 30, prior to indexing the rotary plate 12 further to the next station, namely the pulling-off station 32, where the pantyhose, being folded in the longitudinal direction, is pulled off the stretchers 40, 42 (not shown in the drawing) by means of pulling-off devices that can be moved laterally against the end faces of the stretchers 40, 42.

After completion of the mounting and inspection process, as the rotary plate 12 is indexed in counter-clockwise direction 16 by an angle of 45°, the pantyhose 70 reaches the following intermediate station 20.

The intermediate station 20 merely serves to turn the two stretchers 40, 42 in clockwise direction about a common axis 54, so as to return them to their initial position. This simplifies the structure of the turning unit 38, which additionally permits to turn the first stretcher 40 toward the first stretcher 42 and to lock the stretchers 40, 42 in their respective final positions.

At the end of a further rotation of the rotary plate 12 by 45°, the pantyhose 70 is introduced into an open steam chamber 48 at the shaping station 22. After the steam chamber 48 has been closed by moving its two halves toward each other, in the direction of arrows 50, 52, and after the steam chamber 48 has been locked, the pantyhose 70 is exposed at that station to steam at a temperature of 120° to 140° C. The time of exposure to the steam is approximately one second, three further seconds being required for opening and closing, for locking and unlocking the steam chamber 48, and for building up and releasing the steam pressure. Another second is required for turning the rotary plate by 45°. One thus obtains a cycle speed of twelve cycles per minute, which means that the operator 36, picking up a new pantyhose 70 within the time of a second, while the rotary plate performs its movement, has sufficient time left, namely four seconds, for mounting the pantyhose, inspecting its front face, rotating the two stretchers 40, 42 by 180°, and for inspecting the back face of the pantyhose.

At the end of the exposure time in the steam chamber 48, the latter is opened, unlocked, and the rotary plate is indexed further by 45°. The pantyhose is now guided successively through a series of four drying stations 24, 26, 28, 30 where the pantyhose 70, having got wet during the steam-shaping process, is dried. The drying stations 24, 26, 28, 30 are equipped for this purpose with heating means 66 fastened outside the rotary plate 12, or on holders 68 on the inside of the rotary plate 12.

As has been mentioned before, at the last drying station 30 the first stretcher 40 is turned about the axis 54 by 180° in order to bring the two stretchers 40, 42 into a mutually parallel position 56.

This permits easy pulling-off of the pantyhose 70 at the subsequent pulling-off station 32, by means of pulling-off elements (not shown in the drawing) that are guided past the end faces, and easy transfer of the pantyhose to the packaging line 34, in the direction of arrow 60, without an additional lengthwise folding operation.

Thereafter, the first stretcher 40 is turned back at the pulling-off station 32 into its aligned position 58, as indicated by arrow 64.

It is understood that in the case of longer cycle times, it is also possible, if desired, to turn the pantyhose 70 at the mounting and inspection station 18 by further 180° after inspection of the back face.

I claim:

1. Device for shaping and inspecting pantyhose for defects comprising flat stretchers for stretching the pantyhose, the stretchers being arranged in pairs one beside the other and so that they can be brought into a mutually aligned position;

means for heat treating the pantyhose while mounted on the stretchers; wherein two neighboring stretchers are mounted for rotation about a common axis by approximately 180° into a second mutually aligned position in order to permit visual inspection of both the front and the back faces of a stretched pantyhose when in said first mutually aligned position and said second mutually aligned position, respectively, said two neighboring stretchers being adapted for heat-treatment with the pantyhose mounted thereon.

2. Device according to claim 1, further comprising a rotary plate capable of rotating about its vertical axis;

a plurality of treating stations that are arranged along the circumferential direction of the rotary plate and between which the stretchers can be moved in a cycle-controlled way, by rotation of the rotary plate, wherein the stretchers are arranged in pairs one beside the other in the circumferential direction of the rotary plate.

3. Device according to claim 2, wherein at least one mounting and inspection station, one shaping station with a steam chamber, one drying station and one pulling-off station are provided.

4. Method for inspecting and shaping pantyhose, comprising the steps of:

fully spreading a pantyhose on fiat stretchers arranged in pairs one beside the other and in a first mutually aligned position;

visually inspecting the front face of the pantyhose while spread on the two stretchers;

commonly rotating the stretchers about a common axis by approximately 180° into a second mutually aligned position;

visually inspecting the back face of the pantyhose while spread on the two stretchers in said second mutually aligned position;

heat-treating the pantyhose while spread on the two stretchers;

pulling the pantyhose off the two stretchers.

5. Method according to claim 4, wherein the stretchers are arranged in pairs along the circumference of a rotary plate that can be rotated about its center axis and wherein the stretchers are guided successively and in cycle-controlled way, by rotation of the rotary plate, through at least one mounting and inspection station, one shaping station and one pulling-off station, all being arranged along the circumference of the rotary plate.

6. Method according to claim 4, wherein the pantyhose is treated with steam in the shaping station and is dried in a subsequent drying station.

* * * * *